US006386887B2

(12) United States Patent
Boiret et al.

(10) Patent No.: US 6,386,887 B2
(45) Date of Patent: May 14, 2002

(54) CONNECTOR PROVIDED WITH CONFIGURABLE CONTACTS

(75) Inventors: Gerard Boiret, Yvre l'Eveque; Christophe Provost, Cherre, both of (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/805,759

(22) Filed: Mar. 13, 2001

(30) Foreign Application Priority Data

Mar. 14, 2000 (FR) ..... 00 03265

(51) Int. Cl.[7] ..... H01R 29/00

(52) U.S. Cl. ..... 439/52; 439/49; 439/43; 439/723

(58) Field of Search ..... 439/488, 294, 439/82, 76.2, 52, 49, 43, 723; 200/51.03, 51.05, 51.06

(56) References Cited

U.S. PATENT DOCUMENTS

| | | | | |
|---|---|---|---|---|
| 3,877,772 A | * | 4/1975 | De Cenzo | 439/712 |
| 4,357,062 A | * | 11/1982 | Everett | 439/54 |
| 4,480,890 A | | 11/1984 | McGlew | 439/488 |
| 4,653,842 A | | 3/1987 | Kirma | 439/712 |
| 4,701,134 A | * | 10/1987 | Jones | 439/43 |
| 4,758,167 A | | 7/1988 | Bepoix | 439/49 |
| 4,773,867 A | * | 9/1988 | Keller et al. | 439/49 |
| 4,859,806 A | * | 8/1989 | Smith | 439/47 |

FOREIGN PATENT DOCUMENTS

| | | |
|---|---|---|
| DE | 1151579 | 7/1963 |
| EP | 0576365 A1 | 12/1993 |

* cited by examiner

*Primary Examiner*—Renee Luebke
*Assistant Examiner*—Briggitte Hammond
(74) *Attorney, Agent, or Firm*—Perman & Green, LLP

(57) ABSTRACT

A connector (1) is provided with configurable contacts (3) such that the contacts can be connected to each other via a printed circuit (16) comprising strip conductors (20) which connect conductive feed-throughs (19) of said printed circuit. For each contact of the connector, a sliding contact (26) which can be displaced between two positions can be connected or not connected to the contact to which it is opposite. The sliding contacts can be maintained between two stable positions via an insulating grommet (37). In a sunken position, the sliding contacts comprise a conductive end which is in contact with a conductive feed-through of the printed circuit and which is in contact with the contact 3. In a withdrawn position, the sliding contact is only in contact with the conductor opening.

12 Claims, 4 Drawing Sheets

CONNECTOR PROVIDED WITH CONFIGURABLE CONTACTS

The present invention relates to a connector provided with configurable contacts. More particularly, the invention is suitable for use in the field of connectors of the programmable shunt type, said connectors being provided so as to permit certain of their contacts to be activated selectively and/or to permit the contacts disposed in said connector to be selectively connected to each other. In particular, the invention is suitable for use in the field of aviation, particularly in the field of connectors for aircraft engines. A connector according to the invention has the advantage that it can be used under difficult external conditions, particularly at high temperatures of the order of 150° C.

Connectors are known in the prior art which are provided with contacts and which are generally mounted on printed circuits. A printed circuit comprises fixed tracks which are generally etched in a substrate of the circuit. In order to connect one track to another as required when the pattern of the printed circuit does not provide for this, it is necessary to provide each track with contact blocks at desired points, and subsequently to make a connection between said contact blocks. For this purpose, a connector is known in the prior art which is provided with contacts such that first ends of said contacts can each be connected, for example, to a contact block of the printed circuit.

Moreover, these contacts each comprise a second free end on a rear face of the connector. In the prior art, in order to connect these two free ends of the same connector to each other and/or to short-circuit them, a conductor element is used which is placed in contact with at least two of said second free ends. In particular, a connector is known from document EP-A-0 576 365 which is provided with contacts such that each contact can be connected to another via a U-shaped bar. These U-shaped bars are generally disposed in a cap which can be mounted on the rear face of the connector. Given that the connector comprises a plurality of contacts, there is a considerable number of possible combinations of contacts with each other. For this purpose, it is necessary to design as many possible forms of U-shaped bars as there are possible combinations between the contacts. Furthermore, the same cap has to be able to receive fittings which are different from said U-shaped bars, whilst ensuring that only the desired connections are made.

Caps which are provided with U-shaped conductor elements which are separated from each other by walls are known from the teaching of document EP-A-0 576 365, said conductor elements being connected to each other at the height of the wall which separates each of said juxtaposed U-shaped conductor elements. If a partition is of low height, a widened leg of the U-shaped conductor element which is adjacent to one side of said partition will be forced against a leg, which is also widened, of another U-shaped conductor element disposed on the other side of said partition. In this document, the proposed configuration of short-circuits is thus defined by the respective heights of the partitions of the cap. The cap is a rigid but non-configurable structure. It is therefore necessary for the caps to be designed with as many possible distributions of partition heights as there are possible combinations of connections between contacts.

This solution gives rise to a problem. Even if it is easily implemented, since a cap can easily be mounted on a connector, it is costly inasmuch as it is necessary to manufacture caps in all possible configurations in order to be able to obtain all the types of connections between contacts which may be desired. Moreover, these connectors are not flexible, because their configuration is a fixed, intrinsic part of them. Therefore, in order to modify the connections between contacts, it is absolutely necessary to remove the cap and to take out the U-shaped conductor elements, to dispose the U-shaped bars in a suitable new cap, and to mount this new cap on the connector. This solution necessitates the use of numerous individual elements, which have to be kept in stock and which may become lost when the configuration of the connector and of the contacts is changed. This results in increased costs when conducting connectors of this type are used.

The object of the present invention is to remedy the aforementioned problem by proposing a connector which is provided with contacts such that two contacts of said connector can be connected together via a printed circuit board, which is disposed orthogonally to an axis of alignment of the contacts, via movable conductors or pistons. Said pistons can be placed in two stable positions. Moreover, the pistons pass through conductor openings of the printed circuit board, and according to the position in which they are placed can be connected or not connected to the contacts which are present in a connector such as this. Thus, if two pistons are in contact with two contacts of the connector, and if in addition these two pistons pass through openings of the printed circuit which are connected to each other, then the two contacts are connected to each other.

The connector according to the invention comprises a housing provided with an insulating body in which contacts are disposed in such a way that the contacts are elongated in the interior of the housing and comprise first ends at the first opening of the housing, and comprise a second end at a second opening of the housing. The second opening in the housing is opposite the first opening. Moreover, the contacts are each of a form which is complementary with an end of a piston to which they can be connected. In a preferred example, this end is in the form of a socket for receiving a pin formed by the end of the piston. Furthermore, the pin of the piston makes contact with conductive feed-throughs of the printed circuit board. The printed circuit board comprises strip conductors which connect certain conductor openings to each other.

Thus, by means of pins of pistons which are connected to sockets of contacts of the connector, and which are also connected to each other via a printed circuit, these contacts of the connector can be connected to each other even if they are juxtaposed and insulated from each other. Moreover, the solution proposed according to the invention has the advantage that the connector does not require any additional component in order to be configured. Simply displacing a piston from a withdrawn position to a sunken position enables a modification to be made to the connection configuration of the contact of the connector which is opposite said piston. This modification can be made manually. Furthermore, this configuration is stable when the connector is used, because it is retained elastically, and because in a preferred embodiment it is protected by an end cap disposed on the rear face of the connector housing.

The present invention relates to a connector comprising a housing, contacts, and an insulating body comprising said contacts such that a first end of said contacts is disposed at an opening of the housing, characterised in that it comprises a printed circuit and sliding contacts, said sliding contacts being in contact with conductive feed-throughs of the circuit, which feed-throughs can be connected to each other by strip conductors, wherein each of said sliding contacts can be selectively placed in contact with a second end of the contacts.

The invention will be better understood from the description given below and by an examination of the accompanying drawings, which are presented merely as an indication of the invention and which by no means limit the invention. The drawings are as follows.

Figure 3A:
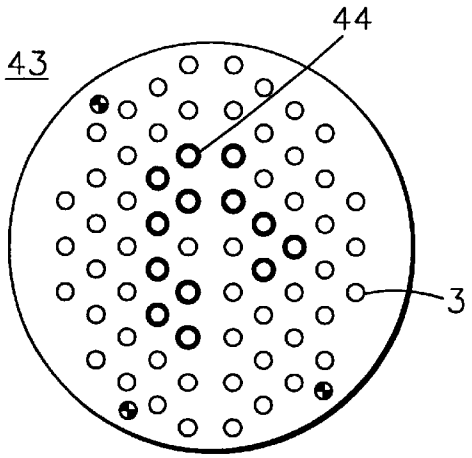
Figure 3B:
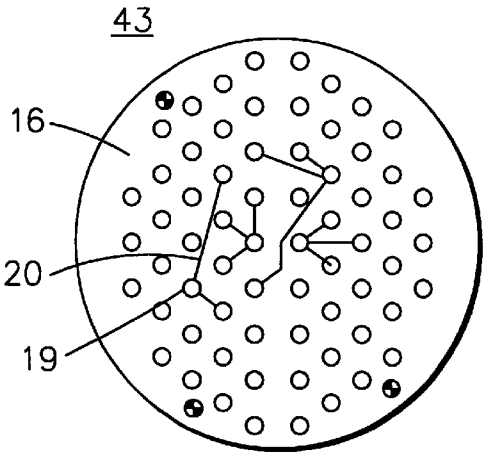
Figure 3C:
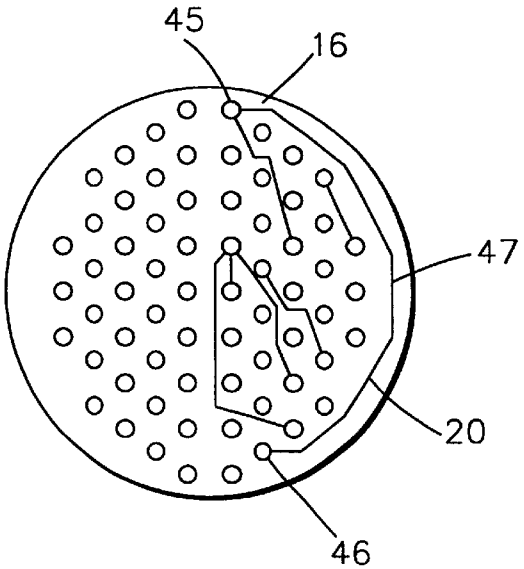
Figure 4C:
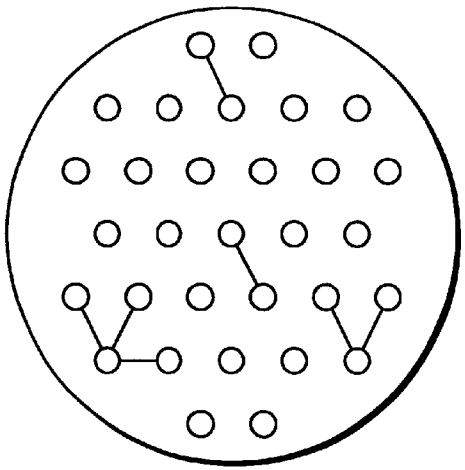
Figure 4A:
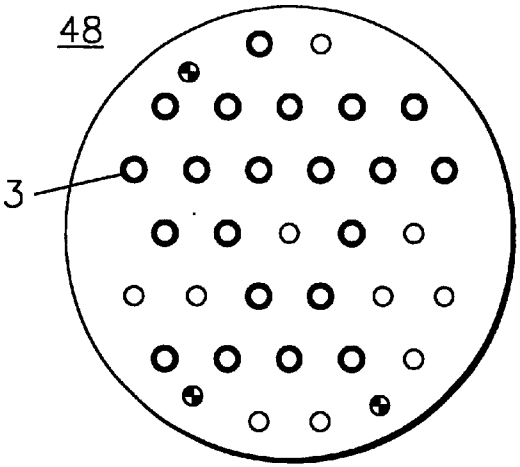
Figure 4B:
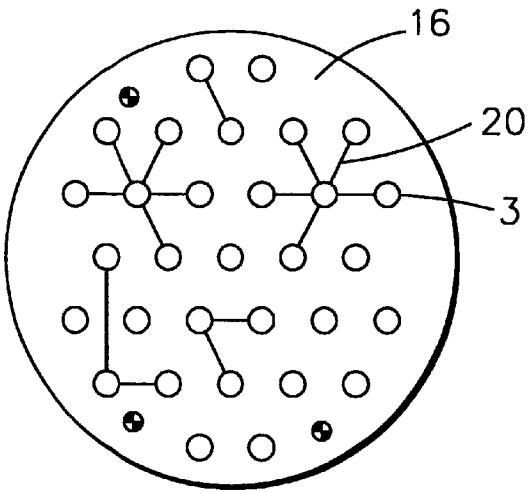

FIG. 3*a* is a view from above of a rear face of a male connector according to the invention;

FIG. 3*b* is a cross-section through a first connection embodiment of a male connector according to the invention;

FIG. 3*c* is a cross-section through a second connection embodiment of a male connector according to the invention;

FIG. 4*a* is a view from above of a rear face of a female connector according to the invention;

FIG. 4*b* is a cross-section through a first connection embodiment of a female connector according to the invention; and FIG. 4*c* is a cross-section through a second connection embodiment of a female connector according to the invention.

Figure 1:
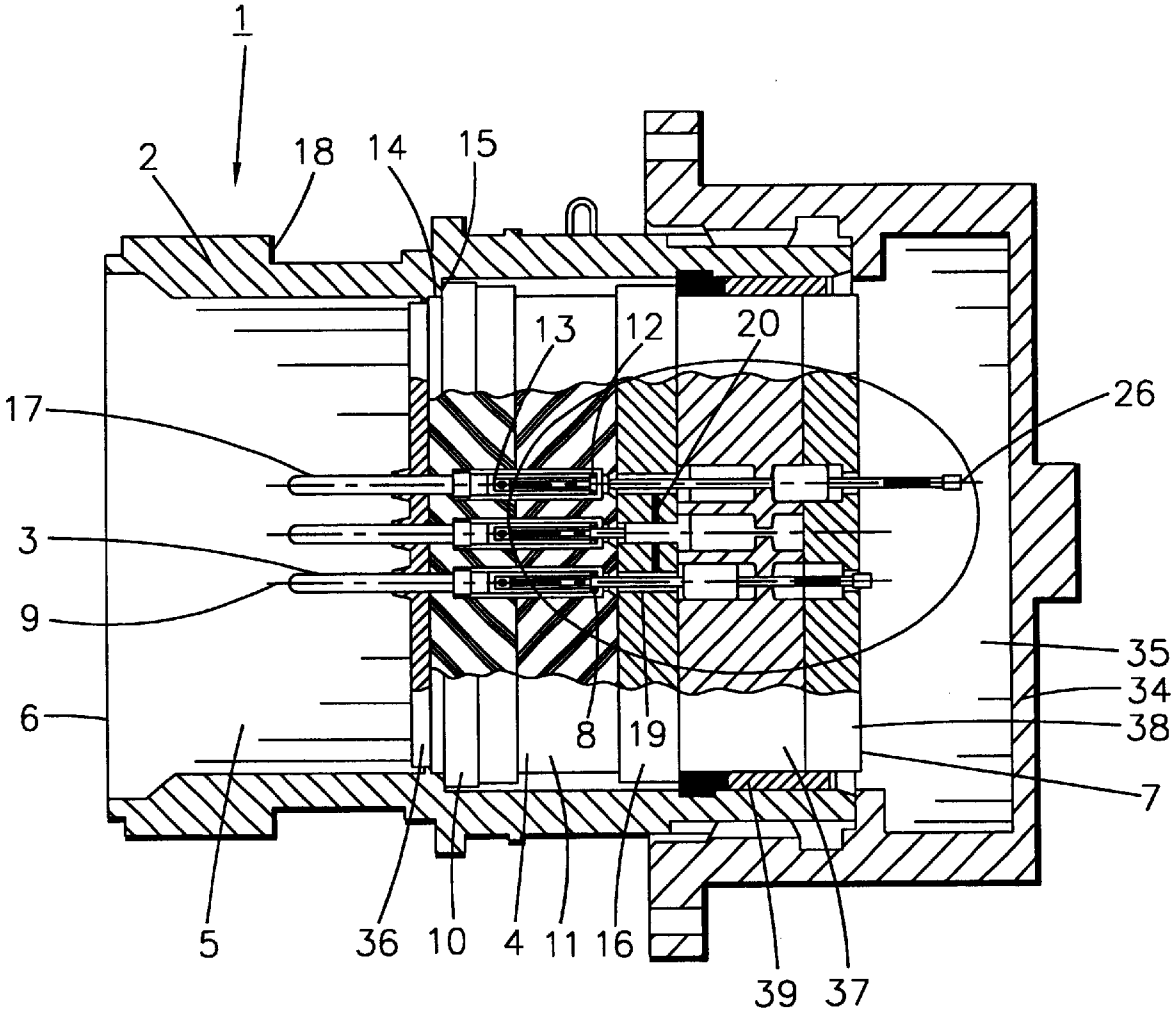
FIG. 1 is a longitudinal section through a connector according to the invention.

FIG. 1 shows a connector 1 according to the invention. The connector 1 comprises a housing 2 and contacts 3. It also comprises an insulating body 4. The housing 2 is hollow, and the insulator 4 is disposed transversely in a cavity 5 in the housing 2. The housing 2 comprises a front opening 6 and a rear opening 7. The front and rear openings 6 and 7 are opposite each other. The contacts 3 are elongated in the interior of the housing 2 through compartments 8 of the insulating body 4 so that the contacts 3 have a preferential connection axis 9. The connection axis 9 is orthogonal to a front face of the insulating body 4 and is therefore orthogonal to the planes formed by the openings 6 and 7 of the housing 2.

The insulating body 4 preferably comprises two insulating modules 10 and 11. Insulating module 10, for example, is disposed at the side of opening 6, and insulating module 11 is disposed at the side of opening 7. Insulating modules 10 and 11 are adhesively bonded face to face. They each comprise compartments such that said compartments are placed opposite each other so as to form compartments 8 which are provided for receiving the contacts 3.

In the example shown in FIG. 1, the connector 1 is a male connector. In this example, the contacts 3 comprise pins which form the first free ends thereof in the cavity 5 at the side of opening 6. In another example, the connector 1 can also be a female connector. In the latter case, the contacts 3 generally comprise a socket at their first end.

The insulating module 10 has a different structure 1 depending on the manner in which it surrounds the contacts 3 which have a first male or female end. When the contacts 3 are male contacts, the insulating module 10 is of reduced thickness so that it allows the male ends to pass into the cavity 5. In contrast, when the contacts 3 are female, the insulating module 10 can be of a length such that it covers the entire external surface of the female ends. The insulating module 10 performs a holding function.

On the other hand, irrespective of whether the connector is male or female, the contacts 3 always comprise a socket 13 at a second end. The socket 13 is situated in the insulating module 11. Irrespective of whether the connector is male or female, the insulating module 11 preferably always has the same structure so that it comprises sockets such as the sockets 13 of contacts 3.

The contacts 3 are preferably disposed parallel to each other. They are therefore insulated from each other. In a preferred example, the contacts 3 are disposed in a symmetrical arrangement in the housing 2.

The insulating body 4 is firstly held in the housing 2 by the action of an internal chamfer 14 on the housing which abuts against a shoulder 15 on the insulating module 10. Secondly, the insulating body 4 is held via a printed board 16 which is disposed in the interior of the housing 2. Therefore, the mobility of the insulating body 4 inside the housing 2 is very low. Consequently the contacts 3 which are held in the insulating modules 10 and 11 are also fixedly held in the interior of the housing 2.

The contacts 3 have a first end 17 which is intended to receive a complementary contact. The contacts 3 of one connector 1 are intended to make contact with complementary contacts of a complementary connector. For example, said complementary connector can be held on the connector 1 at an external step 18 on the housing 2, said step 18 being provided on a front part at the side of the opening 6.

Figure 2:
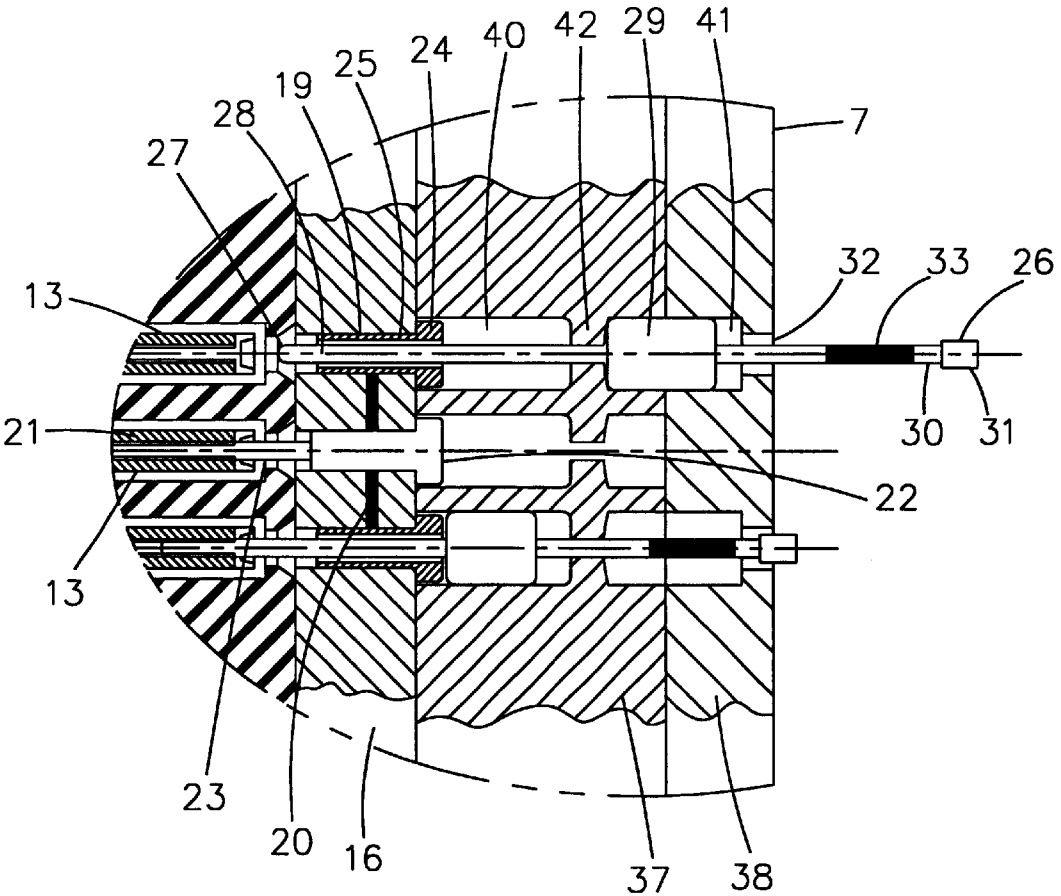
FIG. 2 is a longitudinal section, in detail, through part of the connector according to the invention.

The board 16 is preferably a printed circuit board. It firstly comprises strip conductors 20 and secondly comprises conductive feed-throughs 19 which are optionally connected to each other by strip conductors 20. In FIG. 2, the conductive feed-throughs 19 of the printed circuit 60 are preferably disposed opposite the sockets 13 of the contacts 3. In a preferred example, each of the sockets 13 is disposed opposite a conductive feed-through 19 such as this.

For certain contacts, for example the contact 21 shown in FIG. 2, the conductive feed-through such as 19, which is disposed opposite the socket such as 13 of said contact 21, is crossed by a contact element 22. The contact element 22 is embedded through the conductive feed-through 19 and comprises a strip conductor 23 which is embedded in the socket 13 of the contact 21. This conductor element 22 is not specifically removable.

The conductive feed-through 19 of the board 16 is made conductive, for example, via a conductive socket 24 which is disposed inside a hole formed in the board 16. Therefore, the socket 24 slightly reduces the inside diameter of the conductor openings 19. In one preferred embodiment, the inside diameter of an opening 19 which is provided with a conductive socket 24 such as this is of the order of 1 mm, namely up to 1.06 mm. A socket 24 is preferably provided with lateral strips 25 such that said lateral strips 25 are slightly curved towards the interior of the conductive feed-through 19. Thus, when a conductor element is introduced into the conductive feed-through 19, the lateral strips 25 are forced against said conductor element. It is thus assured that there is a good connection between the conductor element which is introduced and the conductive feed-through 19.

The printed circuit 16 comprises strip conductors 20. Said strip conductors 20 can either be disposed on an upper face or on a lower face of the printed circuit 16. In one preferred example of use, even though the printed circuit 16 is interposed between two insulating elements, a printed circuit 16 is selected which is provided with strip conductors 20 disposed within a thickness of the printed circuit 16. Thus the strip conductors 20 are not subjected to physical changes during normal use of a connector 1 such as this.

Finally, a connector 1 according to the invention comprises a sliding contact 26. In one preferred embodiment in particular, a sliding contact 26 comprises a male contact 28 in a front part 27. The front part 27 is provided so that it is complementary to the second end 12 of the contact 3 of the connector 1. In the present case, given that the end 12 is a socket 13, the front part 27 is a pin 28. In a variant, provision can be made for the connector to be designed so that the end 12 of the contact 3 is a male pin. The front part 27 of the sliding contact 26 is then a female socket.

Secondly, the sliding contact 26 comprises a bulbous portion 29 forming a protuberance on the external periphery of the pin 28. The sliding contact 26 also comprises a second end 30 such that said second end 30 is opposite the front part 27 and protrudes at the opening 7. With the aid of this second free end 30, the sliding contact 26 can easily be gripped and said sliding contact 26 can therefore easily be displaced in relation to the connector 1. Moreover, said sliding contacts can even be grasped manually provided that the ends 30 are sufficiently distant from each other. The sliding contacts 26 can be placed in two positions. In its sunken position, the pin 28 is in contact with the socket 13 and is introduced into the latter. In contrast, in its withdrawn position the pin 28 is no longer in contact with the socket 13.

However, irrespective of the position of the sliding contact 26, the front part 27 of said sliding contact is always in contact with the conductor opening 19, particularly with the conductive bushing 24.

The sliding contact 26 performs the function of a piston. It effectively protrudes at the side of the opening 7 and comprises a gripping means 31 which is larger than the diameter of an opening 32 through which the sliding contact 26 slides. Thus the sliding contact 26 can always be gripped and can therefore always be displaced. This gripping means 31 is ergonomic.

Along its end 30, the sliding contact 26 comprises a sliding indicator 33 such that said sliding indicator enables it to be determined whether the sliding contact 26 is in its withdrawn position or in its sunken position. When said sliding indicator 33 can be seen, this indicates that the sliding contact 26 is in its withdrawn position, and therefore means that there is no connection to a socket 13 of a correspondingly disposed contact 3. It is thus easy to identify the configuration in which the sliding contact 26 is situated.

According to the invention, provision is also made for the housing 2 to be provided with an end cap 34. Said end cap 34 is disposed around the housing 2 at the opening 7, and is pushed on to the housing 2 so that the sliding contacts 26 are protected. In fact, no matter whether the sliding contacts 26 are in their withdrawn position or in their sunken position, a space 35 is defined between the opening 7 and the end cap 34 which leaves the second end 30 of the sliding contacts 26 free. The sliding contacts 26 are thus protected from an involuntary manipulation which would result in a modification of the configuration in which the connector 1 is placed, or which could result in the destruction by bending of the sliding contacts 26.

According to the invention, a connector 1 comprises an interfacial cover 36 which is disposed at the opening 6 and which is provided with openings which allow the contacts 3 to pass through. This interfacial cover 36 is insulating, and forms a seal with the interior of the connector. In particular, the interfacial cover 36 comprises as many openings are as there are contacts 3 in a connector 1. In contrast, if the contacts 3 are female contacts there is no interfacial cover 36 provided that the first insulating module 10 is designed so that it covers the entire length of the end 17 of the contacts 3 whilst allowing the latter to be connected to the contacts of a complementary connector. In this case, it is the insulating module 10 which ensures that the connector 1 is sealed at the opening 6.

According to the invention, in order to enable the sliding contact 26 to be placed in two stable positions according to choice, the connector 1 comprises a grommet 37. Said grommet 37 is an insulating sealing cover and is preferably disposed against a face of the printed circuit 16. The grommet 37 is held in the connector 1 via a back-plate 38 which is provided with lateral tabs which are locked in complementary openings in an internal wall of the housing 2. The grommet 37 has as many compartments as there are sliding contacts 26. In the same manner, the back-plate 38 has as many compartments as there are sliding contacts 26.

The compartments of the grommet 37 and the compartments of the back-plate 38 are disposed opposite each other.

In one particular embodiment of the invention, given that a sliding contact 26 comprises a bulbous portion 29, two compartments in which the bulbous portion 29 can be disposed are formed in the corresponding compartments of the grommet 37 and of the back-plate 38. These two compartments enable a withdrawn position to be provided for the sliding contact 26. A first compartment 40 is delimited by a second compartment 41 via a lip 42 which protrudes towards the interior of said compartments.

Said internal lip 42 is preferably formed inside the grommet 37. Since the grommet 37 is made of a plastics material, and is preferably made of a silicone-based material, the lip 42 is itself elastic. It can therefore be placed under stress when the sliding contact 26 is displaced in order to move it from a withdrawn position to a sunken position and vice versa. The internal lip 42 is designed so that it allows the bulbous portion 29 to pass through when sufficient stress is exerted on the sliding contact 26. However, it also enables the bulbous portion 29 to be firmly held in each of said two compartments 40 and 41. Thus, when a sliding contact 26 is disposed in one of these two positions, it is fixed in place even if the connector is subjected to strong vibrations or to mechanical shock. In fact, it is only a sufficient intentional action on the sliding contacts 26 which enables the configuration in which the connector 1 has been placed to be modified.

In a variant, provision can be made for the sliding contact 26 not to be provided with a protuberant bulbous portion 29, but to be provided with indents. An indent such as this can be created by at least two protuberances which are formed in the interior of the compartments of the grommet of 37 and of the back-plate 38, respectively. In this variant, the two protuberances are preferably formed only in the interior of the grommet 37 which is made of a more elastic material. The back-plate 38 is preferably rigid.

In particular, the back-plate 38 makes it possible to hold the gripping means 31 of an indent which is too deep in the grommet 37. In this manner, the sliding contact 26 is prevented from being too deeply embedded in the socket 13.

According to the invention, a connector 1 is preferably provided with contacts 3 such that said contacts 3 are disposed in a standardised layout. FIG. 3*a* illustrates a male connector 43 according to the invention such that the male connector 43 comprises, for example, 66 contacts such as contact 3 which are juxtaposed parallel to each other. FIG. 3*a* shows that the connector 43 comprises contacts 3 such that contacts 3 are selectively connected to each other. In FIG. 3*a*, for example, contacts 19, 20, 21, 22, 27, 28, 30, 31, 36, 37, 46, 47 and 54, which are indicated by 44, are irreversibly connected to a conductor element such as 22. The other contacts, such as contact 3, of the connector 43 are themselves provided with sliding contacts 26. Each of the sliding contacts 26 can therefore be configured in a withdrawn position or in a sunken position.

FIG. 3*b* shows a printed circuit board such as 16 which is installed in the male connector 43, for example. This board comprises conductive feed-throughs such as 19, which are connected to each other by strip conductors 20. Said strip conductors 20 are disposed so that they result in quite specific arrangements of the feed-throughs in relation to each other. This arrangement then corresponds to one pattern of possible connections between the contacts. In fact, just because a piston contact 26 is sunk within a contact 3, this does not mean that it cannot be connected to other contacts 3 of the connector 1.

Moreover, if the conductor opening 19 which corresponds to this piston contact 26 is not connected to a strip conductor 20, then, irrespective of whether the piston contact 26 is sunken or withdrawn, this changes nothing with regard to the contact 3. The arrangement, and the switching of the contacts between each other, are therefore defined firstly by the sliding contacts 26 and secondly by the arrangement of the proposed strip conductors 20 between the conductor openings 19.

As illustrated in FIG. 3*c*, the strip conductors 20 enable contacts 3 which are distant from one another to be connected. In FIG. 3*c* for example, a contact 45 is connected to the contact 46 which is opposite contact 45 by a strip conductor 20 which passes through a periphery 47 of the printed circuit 16. Moreover, in FIGS. 3*b* and 3*c*, it can be seen that the same conductive feed-through 19 can be connected to a plurality of conductive feed-throughs 19 by a plurality of strip conductors 20.

FIGS. 4*a*, 4*b* and 4*c* illustrate another type of design of a connector 48 according to the invention, in which the contacts such as 3 are female and are disposed spaced apart somewhat further. In the same manner as for the male connector 43, the connector 48 which is illustrated in FIG. 4*a* firstly comprises contacts 3 which are provided with a contact element such as 22, and which are provided with other contacts 3 which are connected to sliding contacts 26. Thus the arrangement and modes of switching between the different contacts such as 3 of a connector 48 such as this are mainly defined via the arrangements of the strip conductors such as 20 which are part of printed circuits such as 16 which comprise irreversible strip conductors. These strip conductors 20 are preferably disposed between contacts which are provided with, or which can be connected to, sliding contacts such as 26. However, provision may also be made for connecting a strip conductor 20 to a contact which is provided with a conductor element such as 22. Thus a contact which is provided with a piston such as 26 can be reversibly connected to a contact which is provided with a conductor element 22.

What is claimed is:

1. A connector (1) comprising a housing (2), contacts (3), and an insulating body (4) comprising said contacts such that a first end (17) of the contacts is disposed at an opening (6) of the housing, characterised in that it comprises a printed circuit (16) and sliding contacts (26), said sliding contacts being in contact with conductive feed-throughs (19) of the circuit, which feed-throughs can be connected to each other by strip conductors (20), wherein each of the sliding contacts can be selectively placed in contact with a second end (13) of the contacts.

2. A connector according to claim 1, characterised in that it comprises an insulating grommet (37) for selectively receiving a bulbous portion (29) of a sliding contact, in a sunken position or in a withdrawn position of the sliding contact.

3. A connector according to claim 2, characterised in that the grommet comprises two communicating compartments (40, 41) separated by an elastic lip (42) so that the bulbous portion of the sliding contact is elastically held retained in one of the compartments.

4. A connector according to claim 1, characterised in that the second end of the contacts is a socket (13) for receiving pins (28) of the sliding contacts.

5. A connector according to claim 1, characterised in that it comprises bushings (24) provided with mechanically biased strips (25) disposed through the conductive feed-throughs.

6. A connector according to claim 1, characterised in that the sliding contacts comprise a protruding piston (31) on one face (7) of the housing, said face being opposite to the opening (6).

7. A connector according to claim 1, characterised in that it comprises a backplate (38) which allows a free end (31) of the sliding contacts to pass through it.

8. A connector according to claim 1, characterised in that the housing comprises a rear end cap (34) for protecting the sliding contacts.

9. A connector according to claim 1, characterised in that it comprises sliding contacts (22) which are irreversibly maintained in connection with a contact and with a conductive feed-through.

10. A connector according to claim 1, characterised in that the first ends (17) of the contacts are male pins or female sockets.

11. A connector according to claim 1, characterised in that the first ends of the contacts are insulated from each other by an interfacial insulating cover (36).

12. A connector according to claim 1, characterised in that the strip conductors of the printed circuit are embedded in a thickness of said printed circuit.

* * * * *